United States Patent [19]

Barnhart

[11] Patent Number: 4,801,045

[45] Date of Patent: Jan. 31, 1989

[54] PRODUCE DISPENSER

[76] Inventor: William D. Barnhart, 629 Ransom St., Ripon, Wis. 54971

[21] Appl. No.: 947,287

[22] Filed: Dec. 29, 1986

[51] Int. Cl.[4] ..... A47F 1/04

[52] U.S. Cl. ..... 221/305; 221/306; 229/122

[58] Field of Search ..... 221/303—306, 221/281-283, 287, 191, 194, 197; 229/122, 17 B; 312/49, 42, 260, 259

[56] References Cited

U.S. PATENT DOCUMENTS

| | | | |
|---|---|---|---|
| 1,645,771 | 10/1927 | Pillsbury | 229/17 B X |
| 1,840,439 | 1/1932 | Ewell | 221/306 X |
| 1,898,056 | 2/1933 | Johnson | 229/122 X |
| 1,972,406 | 9/1934 | Marsh | 221/305 |
| 1,999,021 | 4/1935 | Marsh | 221/197 X |
| 2,177,495 | 10/1939 | McGuire | 229/17 B |
| 2,595,202 | 4/1952 | Pardee | 229/122 X |
| 3,616,989 | 11/1971 | Martinek | 229/122 X |

FOREIGN PATENT DOCUMENTS

| | | | |
|---|---|---|---|
| 668603 | 8/1963 | Canada | 229/17 B |

*Primary Examiner*—Joseph J. Rolla
*Assistant Examiner*—David H. Bollinger
*Attorney, Agent, or Firm*—Donald Cayen

[57] ABSTRACT

A produce dispenser comprise two members that cooperate to form a column for a stack of produce items. The first member as an upper end that is adapted to hang the dispenser on a vertical surface and a bottom platform that supports the items. The second member is preferably slideable over the first member to selectively totally enclose the stack of items or to expose the lowermost piece of produce in the stack. The dispenser may be made of foldable paperboard or of a moldable plastic material.

4 Claims, 3 Drawing Sheets

PRODUCE DISPENSER

BACKGROUND OF THE INVENTION

1. Field of the Invention

This invention pertains to food, handling, and more particularly to apparatus for storing and dispensing individual pieces of produce.

2. Description of the Prior Art

Consumers usually buy produce such as apples and oranges in bulk. The produce is normally inserted into a paper or plastic bag for easy handling. At home, the consumer may remove the produce from the bag and store it in a refrigerator drawer. Often, she leaves the produce in the bag and places both bag and produce in the refrigerator. In either case, the produce is conveniently out of sight. Occasionally, fruit may be displayed in a fruit bowl or in a similar decorative manner.

It frequently occurs that a person desiring a snack is tempted to eat whatever is in view. Consequently, he often overlooks the healthy fruit stored in the refrigerator. Instead, he chooses a less healthy but more conspicuously placed and readily accessible food product. Although the fruit in a fruit bowl is conveniently at hand, many persons are reluctant to take a piece for fear of disturbing the aesthetic qualities of the arrangement.

Thus, a need exists for a receptacle that both stores produce items and exposes them to view.

SUMMARY OF THE INVENTION

In accordance with the present invention, a dispenser is provided that unobtrusively stores individual items while simultaneously displaying them and rendering them readily accessible. This is accomplished by apparatus that includes a vertical chute surrounded by a sleeve that preferably is slideable along the chute to selectively create and remove a dispensing opening in the dispenser.

The chute has three elongated walls that partially define a column for holding a vertical stack of individual items, which may be produce items such as apples or oranges. A horizontal bottom platform ties the lower ends of the three walls to each other and also supports the stack of fruit or other items. The bottom platform is preferably formed with an opening sized to retain the lowermost piece of fruit in place. The lower sections of the two side walls are cut out to a size and shape that permit a person's hand to pass through the cutouts and grasp the lowermost piece of fruit stacked in the chute. In addition, the chute may have a top panel that opens or closes the chute upper end.

To retain the fruit within the three-sided chute, the sleeve has four sides, and it fits rather snugly around the chute. The sleeve preferably has the same length as the chute. The sleeve preferably is slideable between a first position wherein its ends coincide with the chute ends and a second position wherein a portion of the chute open side and the chute cutouts are exposed.

To use the produce dispenser of the present invention, the sleeve is placed in the first position over the chute. The top panel is opened, and the chute is filled with the appropriate number of produce items. The top panel is then closed, thereby capturing the fruit within the dispenser. At home after purchase, the consumer opens the top panel and slides the sleeve upwardly on the chute sufficiently to expose the chute cutouts and to permit a single piece of fruit to pass between the sleeve lower end and the chute bottom platform. She then hangs the dispenser on a wall hook by means of holes in the top panel and sleeve. Accordingly, the fruit is neatly stored in an unobtrusive manner, but it nevertheless remains within sight and immediately accessible to hungry persons.

The produce dispenser of the present invention may be manufactured from any suitable material. A particularly desireable material is a relatively stiff but foldable paperboard. That material is inexpensive and readily produceable in blanks that can be appropriately folded into the requisite shapes and then glued.

In a modified embodiment, the produce dispenser of the present invention is manufactured as an elongated tray having a curved bottom platform. A cover having three sides and a top wall snaps in place over the tray to create an enclosed column for stacking the fruit. The cover is preferably slideable upwardly along the tray to a position that exposes the lowermost piece of fruit adjacent the curved bottom platform. The tray upper end has a hole for hanging the dispenser in a vertical orientation on a wall.

In another modified version, a three-sided cover is permanently attached to the tray, and the top of the cover may be open. The lower portions of the cover opposed side walls are formed with cutouts that permit a person to grasp and remove the lowermost item within the dispenser.

The modified versions may be manufactured from a thermoplastic material. Preferably, the material is a clear acrylic plastic that permits viewing the entire contents of the dispenser.

Other features and advantages of the invention will become apparent to those skilled in the art upon reading the detailed description.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
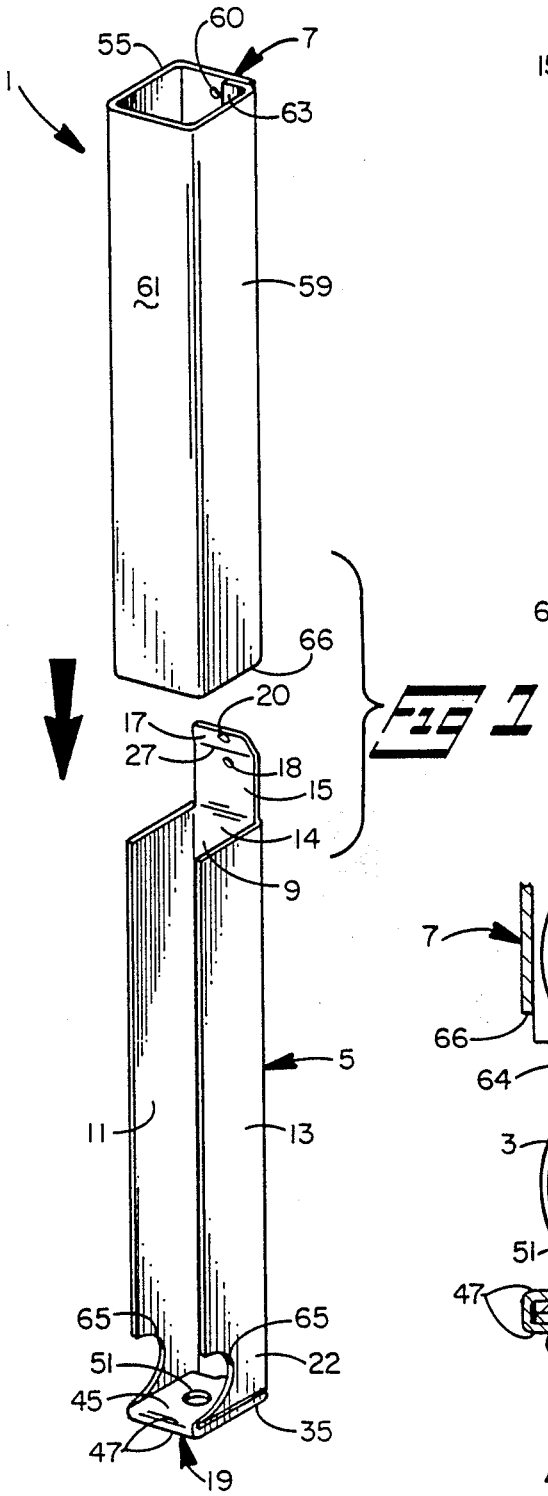
FIG. 1 is an exploded perspective view of the present invention.
Figure 2:
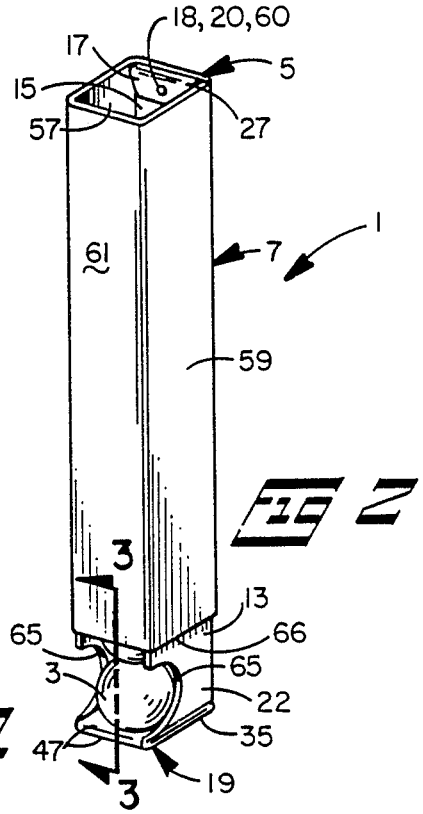
FIG. 2 is a perspective view of the present invention shown in the assembled mode and in a condition for dispensing articles.

Referring to FIGS. 1 and 2, a produce dispenser 1 is illustrated that includes the present invention. The produce dispenser is particularly useful for storing and dispensing individual items of fruit symbolically represented by reference numeral 3. However, it will be understood that the invention is not limited to food handling applications.

The produce dispenser 1 comprises a chute 5 and a sleeve 7. The chute 5 is fabricated with an elongated back wall 9 and a pair of opposed side walls 11 and 13. Connected to the upper region 14 of the back wall 9 is a top panel 15, which terminates in a flap 17. Two holes 18 and 20 are formed in the top panel 15 and flap 17, respectively. The lower region 22 of the chute has a bottom platform 19 that is joined to the side walls 11 and 13 and the back wall 9.

Figures 4, 5, 6:
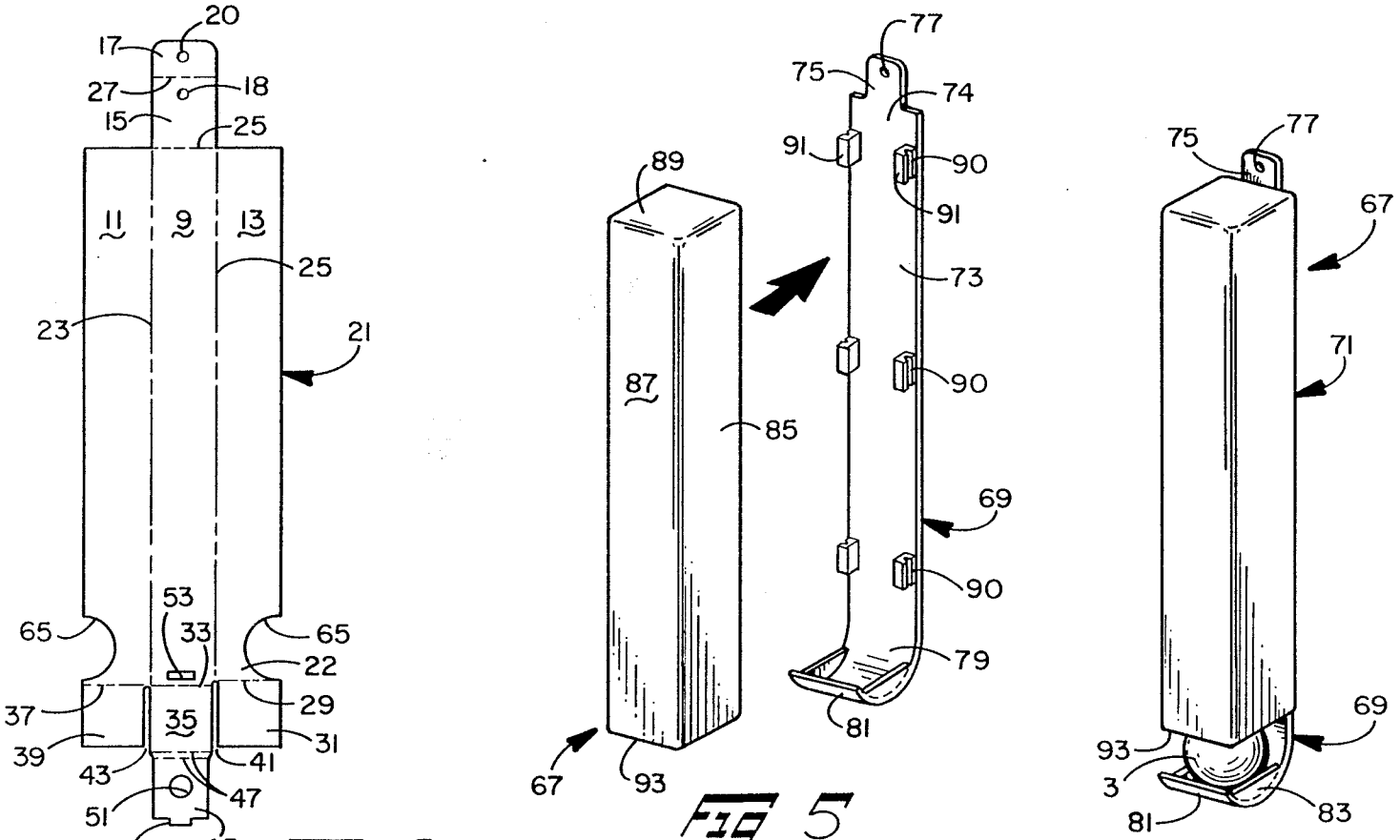
FIG. 4 is a top view of a blank of material from which a portion of the present invention may be fabricated.
FIG. 5 is an exploded perspective view of a modified embodiment of the present invention.
FIG. 6 is a perspective view of the embodiment of FIG. 5 shown in an assembled mode and in a condition for dispensing articles.

Referring to FIG. 4, reference numeral 21 indicates a blank of paperboard or similar material from which the chute 5 may be fabricated. The blank 21 is folded along fold lines 23 and 25 to create the back wall 9 and side walls 11 and 13. A fold line 25 separates the back wall 9 and the top panel 15. Fold line 27 separates the flap 17 from the top panel 15. The fold line 27 is located midway between the holes 18 and 20.

A blank fold line 29 separates a first side flap 31 from the lower region of the side wall 13. Fold line 33, which is preferably nonlinear with fold line 29, separates a bottom panel 35 from the back wall 9. Fold line 37, which, if extended, would preferably lie intermediate the fold lines 29 and 33, separates a second side flap 39 from the second side wall 11. The flap 31 and panel 35 are separated by a slit 41 that extends to the fold line 29. Panel 35 and flap 39 are separated by a slit 43 that extends to the fold line 37. The panel 35 terminates in a bottom end flap 45. A double fold line 47 separates the bottom end flap 45 from the bottom panel 35. The end of the end flap 45 is formed with a tab 49. The lower region 22 of the back wall contains a horizontal slot 53 that has dimensions slightly larger than the corresponding dimensions of the tab 49.

Figure 3:
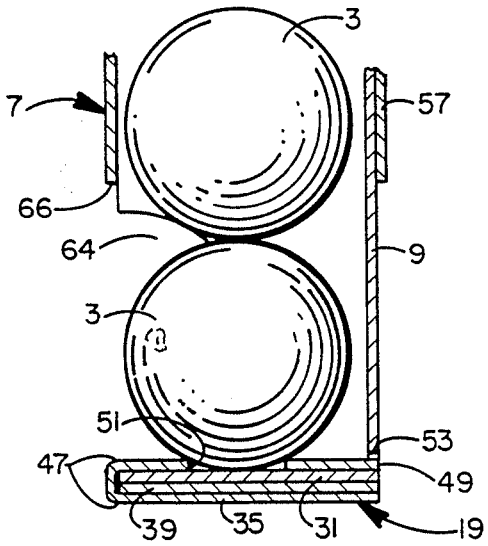
FIG. 3 is an enlarged cross sectional view taken along lines 3—3 of FIG. 2.

Referring primarily to FIGS. 3 and 4, the bottom panel 35 and the flaps 31, 39, and 45 are interfolded so as to create the chute bottom platform 19. For that purpose, the first side flap 31 is folded along fold line 29 so that the flap 31 is perpendicular to the wall 13. Then the wall 13 is folded along fold line 25 so that the wall 13 is perpendicular to the back wall 9. Next, the second side flap 39 is folded along fold line 39 so that it is perpendicular to the wall 11, and the wall 11 is folded along fold line 23 so that the wall is perpendicular to the back wall. In that condition, flap 31 overlies flap 39. The bottom panel 35 is folded so as to be perpendicular to the back wall and underlie the second side flap 39. The blank 21 is further folded along the double fold lines 47 so that the end flap 45 overlies the first side flap 31. Finally, the tab 49 is inserted into the slot 53 in the back wall, thereby completing the bottom platform 19.

In the preferred embodiment, the sleeve 7 is fabricated as an elongated tube-like structure that has the same length as the back and side walls 9, 11, and 13 of the chute 5. The interior of the sleeve is sized to fit snugly but not tightly over the folded chute.

Like the chute 5, the sleeve 7 may be fabricated from a paperboard material. In that case, the sleeve blank would have panels 57, 55, and 59 corresponding with the chute walls 9, 11, and 13, respectively, FIG. 1. A hole 60 extends through the sleeve panel 57. A sleeve front panel 61 and an overlying flap 63 that is bonded to the interior of the panel 57 completes the structure of the sleeve.

In the illustrated construction, the chute 5 is slideably inserted into the sleeve 7 with a snug but not tight fit. When the sleeve is on the chute at a first position, the chute and slide ends are approximately aligned. In that position, the top panel 15 can be opened and the appropriate number of pieces of fruit 3 inserted into the dispenser 1. The top panel is then closed, thereby capturing the fruit and rendering the dispenser ready for handling, shipping, and sale to the consumer.

The consumer opens the top panel 15, slides the sleeve 7 upwardly on the chute 5 until a piece of fruit 3 is capable of being removed from the dispenser through an opening 64 between the lower end 66 of the sleeve 7 and the chute bottom platform 19. In that position, the hole 18 in the chute back wall 9 is aligned with the hole 60 in the sleeve. She then bends the top flap 17 along fold line 27 to align holes 18, 20, and 60 and slips the holes over a hanger on a vertical surface. The lowermost piece of fruit is retained on the bottom platform by an opening 51 in the bottom panel 45, thereby reducing the risk of the fruit rolling off the platform.

To enable a person to easily grasp the lowermost piece of fruit 3 for removal, the lower region 22 of the two side walls 11 and 13 are formed with cutouts 65. Although illustrated as semi-circles, the cutouts 65 need not be of that shape. The only requirement of the cutouts is that they enable the thumb and finger of a person to pass through the side walls to grasp the fruit and withdraw it through the opening 64.

Turning to FIGS. 5 and 6, a modified produce dispenser 67 is depicted. The produce dispenser 67 comprises a tray 69 and a cover 71. The tray 69 is preferably constructed with a flat section 73 having an upper end 74 that terminates in a hanger portion 75. A hanger hole 77 passes through the hanger portion 75. The tray lower end 79 is formed with a forwardly and upwardly curved platform 81. The platform 81 has a radius suitable for holding a piece of fruit 3. To prevent the fruit from rolling off the side of the platform, a short wall 83 may be provided at the bottommost portion of the curved platform. Alternately, a hole, not illustrated but similar to the opening 51 of the produce dispenser 1 described previously, may be formed in the bottom of the curved platform.

The cover 71 is preferably fabricated with two opposed side walls 85, a front wall 87, and a top wall 89. The cover side walls 85 are designed to capture and preferably slide along the opposed longitudinal edges of the tray flat section 73. Any suitable design for sliding capture may be used, as, for example, grooves 90 formed in raised bosses 91 in the tray and mating tongues, not illustrated, in the cover walls. The length of the cover 71 is preferably approximately equal to the length of the tray 69, excluding the length of the tray hanger section 75. The cover is slideable on the tray between a first position wherein the cover lower end 93 approximately coincides with the bottom of the curved platform 81 and a second position wherein the cover lower end 93 is raised above the tray curved platform so as to expose the lowermost piece of fruit 3. In the second position, a person can quickly remove the fruit from the dispenser 67.

Figure 8:
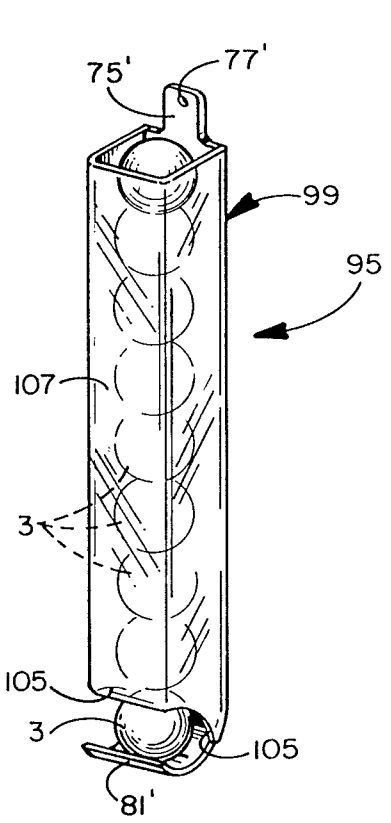
FIG. 8 is a perspective view of the embodiment of FIG. 7 shown in an assembled condition.
Figure 7:
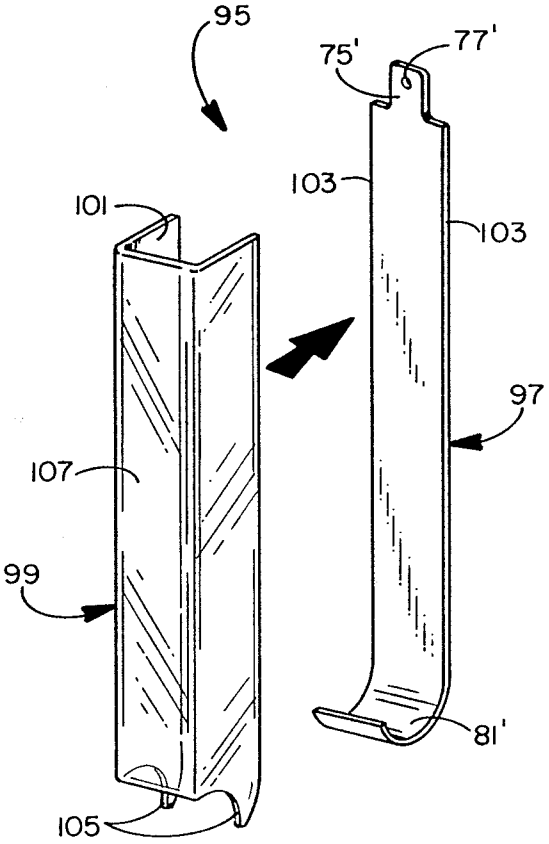
FIG. 7 is an exploded perspective view of a further modified embodiment of the present invention.

Referring to FIGS. 7 and 8, an alternate dispenser 95 according to the present invention is illustrated. The dispenser 95 comprises a tray 97 and a cover 99 that are generally similar to the tray 69 and cover 71 described previously. However, the tray 97 and cover 99 are designed to be assembled together without provisions for vertically sliding the cover on the tray. Thus, the cover side walls 101 and the tray longitudinal edges 103 may be constructed with any of the well known structures, not shown, that permit the cover to snap over and be secured to the tray. If desired, the tray and cover can be manufactured as a single piece in a unitary structure.

The tray 97 has a hanger portion 75' with a hanger hole 77'. The tray lower end is formed with a curved platform 81'. The top of the cover 99 may be open. The lower ends of the cover side walls 101 are formed with cutouts 105. The cutouts 105 are sized to permit a person's hand to grasp a piece of fruit 3 or other object stored in the dispenser 95 and remove it from under the cover front wall 107 while restraining the fruit against rolling out the sides f the platform. It will be appreciated, of course, that the dispensers 67 and 95 are also useful for conveniently storing non-produce items.

The preferred material for the produce dispensers 67 and 95 is a semi-rigid thermosetting plastic. That material is inexpensive, lightweight, strong and tough, and capable of being molded into the described shapes. A particularly desirable material is a clear acrylic plastic, which allows ready viewing of all the fruit 3 stored in the dispenser.

Thus, it is apparent that there has been provided, in accordance with the invention, a produce dispenser that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. Apparatus for storing and dispensing individual items comprising:

a. a sleeve having four connected walls of predetermined length that define a rectangular tube open at both ends and b. a chute slideably inserted into the sleeve, the chute being fabricated from a blank of foldable material comprising:

i. first and second elongated generally rectangular side walls having respective upper and lower ends and predetermined widths;

ii. a generally rectangular back wall having upper and lower ends and a predetermined width, the back wall being interposed between and coextensive in length with the side walls, the back wall being separated from the first and second side walls by respective first and second fold lines;

iii. a first imperforate flap joined to the lower end of the first side wall by a third fold line, the first flap having a length approximately equal to the width of the back wall;

iv. a bottom panel joined to the lower end of the back wall by a fourth fold line and having a length approximately equal to the width of the side walls;

v. a generally rectangular bottom end flap joined to the bottom panel along a fifth fold line parallel to the fourth fold line, the bottom end flap having opposed free edges perpendicular to the fifth fold line and generally colinear with the first and second fold lines; and vi. a second imperforate flap joined to the lower end of the second side wall by a sixth fold line, the second flap having a length approximately equal to the width of the back wall, so that the first and second side walls are foldable along the first and second fold lines, respectively, to be perpendicular to the back wall, the first and second flaps are foldable along the third and sixth fold lines, respectively, to be perpendicular to the first and second side walls, respectively, the bottom panel is foldable along the fourth fold line to be perpendicular to the back wall and underlie the first and second flaps, and the bottom end flap can be folded back along the fifth fold line to overlie the first and second flaps with the opposed free edges of the bottom end flap being adjacent the first and second side walls to thereby create a three-sided chute having a bottom platform wherein the bottom end flap is parallel to the bottom panel and first and second flaps and is unconnected thereto.

2. The apparatus of claim 1 wherein:

a. the end of the bottom end flap terminates in a tab; and b. the lower end of the back wall defines a slot having dimensions slightly greater than the respective dimensions of the bottom end flap tab, so that the tab fits into the wall slot when the bottom end flap is folded over along the fifth fold line to overlie the first and second flaps.

3. Apparatus for storing and dispensing individual items comprising:

a. a sleeve having four connected walls of predetermined length that define a rectangular tube open at both ends; and b. a chute slideably inserted into the sleeve, the chute being fabricated from a blank of foldable material comprising:

i. first and second elongated generally rectangular side walls having respective upper and lower ends and predetermined widths;

ii. a generally rectangular back wall having upper and lower ends and a predetermined width, the back wall being interposed between and coextensive in length with the side walls, the back wall being separated from the first and second side walls by respective fold lines;

iii. a first flap joined to the lower end of the first side wall by a third fold line, the first flap having a length approximately equal to the width of the back wall;

iv. a bottom panel joined to the lower end of the back wall by a fourth fold line and having a length approximately equal to the width of the side walls;

v. a bottom end flap joined to the bottom panel along a fifth fold line parallel to the fourth fold line;

vi. a second flap joined to the lower end of the second side wall by a sixth fold line, the second flap having a length approximately equal to the width of the back wall, wherein the sleeve and chute are approximately the same length and the sleeve is slideable over the chute between a first position in which the corresponding chute and sleeve ends approximately coincide to capture the items and a second position wherein the sleeve lower end is spaced above the chute lower platform to expose at least one stored item;

vii. a top panel joined to the upper end of the back wall along a seventh fold line, the top panel being foldable along the seventh fold line to a first position wherein the sleeve is closed and a second position wherein the sleeve is open; and viii. a top end flap joined to the chute top panel along an eighth fold line parallel to the seventh fold line, and wherein the chute top panel and top end flap and the sleeve define respective holes that are aligned when the end flap is folded over onto the top panel along the eighth fold line and the sleeve is in the second position on the chute, so that the chute and sleeve can be hung vertically by means of the holes in the sleeve and in the chute top panel and top end flap to thereby arrange the stored items in a vertical stack.

4. The apparatus of claim 3 wherein the bottom panel has an opening therethrough for retaining a stored item in the bottom platform of the folded chute.

* * * * *